US007530632B2

(12) United States Patent
Kaloustian et al.

(10) Patent No.: US 7,530,632 B2
(45) Date of Patent: May 12, 2009

(54) SEATING UNIT WITH ACCESSORIES

(75) Inventors: John M. Kaloustian, Northville, MI (US); Russell Plant, London (GB); Robert L. Stewart, Grapevine, TX (US); Paul Thomas Cornell, Grapevine, TX (US)

(73) Assignee: Steelcase Development Corporation, Caledonia, MI (US)

( * ) Notice: Subject to any disclaimer, the term of this patent is extended or adjusted under 35 U.S.C. 154(b) by 497 days.

(21) Appl. No.: 11/142,650

(22) Filed: Jun. 1, 2005

(65) Prior Publication Data

US 2006/0273634 A1 Dec. 7, 2006

(51) Int. Cl.
*A47C 7/62* (2006.01)

(52) U.S. Cl. ..... 297/188.14; 297/161; 297/162; 297/170; 297/173

(58) Field of Classification Search ..... 297/188.14, 297/188.15, 188.2, 170, 161, 162, 173
See application file for complete search history.

(56) References Cited

U.S. PATENT DOCUMENTS 3,156,498 A 11/1964 Blodee
3,322,460 A 5/1967 Leverman
3,586,367 A * 6/1971 Cincotta ..... 297/162
3,712,668 A 1/1973 Fink
3,751,789 A 8/1973 Fink
4,067,606 A 1/1978 Desmoulins nee Fouchereau et al.
4,560,128 A 12/1985 Willeby et al.
5,026,114 A * 6/1991 Miller ..... 297/188.15 X
5,356,107 A 10/1994 Sinohuiz
5,407,249 A 4/1995 Bonutti
5,597,148 A 1/1997 Gospodarich
5,647,075 A 7/1997 Perkins
5,653,499 A 8/1997 Goodall
5,655,743 A 8/1997 Gillis
5,746,480 A 5/1998 Bonutti
5,765,911 A 6/1998 Sorenson
5,865,124 A 2/1999 Wroe
5,901,934 A 5/1999 Wilson
5,931,537 A 8/1999 Gollin et al.
6,003,446 A 12/1999 Leibowitz
6,073,997 A * 6/2000 Koh ..... 297/173 X
6,142,350 A * 11/2000 Alexander ..... 297/188.2 X
6,145,926 A 11/2000 Lin
6,227,511 B1 5/2001 De Costa
6,234,085 B1 5/2001 Ramundo
6,422,646 B1 7/2002 McNally (Continued)

*Primary Examiner*—Anthony D Barfield
(74) *Attorney, Agent, or Firm*—Price, Heneveld, Cooper, DeWitt & Litton , LLP

(57) ABSTRACT

A seating unit includes a tubular support extending upwardly from a chair frame, a retainer telescopingly engaging an upright open end of the support, and an armrest mounted on the retainer. The retainer is keyed at both ends to prevent undesired rotation of the armrest. Accessories are mounted to the retainer, and are positionable at use and non-use positions relative to a seated user. The accessories include a cup holder, a container, a hook for hanging items under the cup holder or container, and different tablets. One tablet includes a wheeled leg that extends downwardly from a center of gravity of the tablet, the leg supporting the tablet and reducing cantilever forces on the retainer. The back and seat comprise a flexible member co-molded onto a supportive partial-perimeter frame member and includes back and seat sections that matably engage corresponding surfaces of the frame member.

13 Claims, 12 Drawing Sheets

U.S. PATENT DOCUMENTS 6,425,631 B1 7/2002 Lin
6,457,772 B1 10/2002 Forston
6,471,290 B1 10/2002 Moody et al.
6,478,371 B1 11/2002 Clarke
D470,727 S 2/2003 Bartley
6,669,282 B2 12/2003 Piretti
6,685,264 B2 * 2/2004 Mullen et al. ..... 297/173
6,749,158 B2 6/2004 Timm
2001/0028548 A1 10/2001 Oura et al.

* cited by examiner

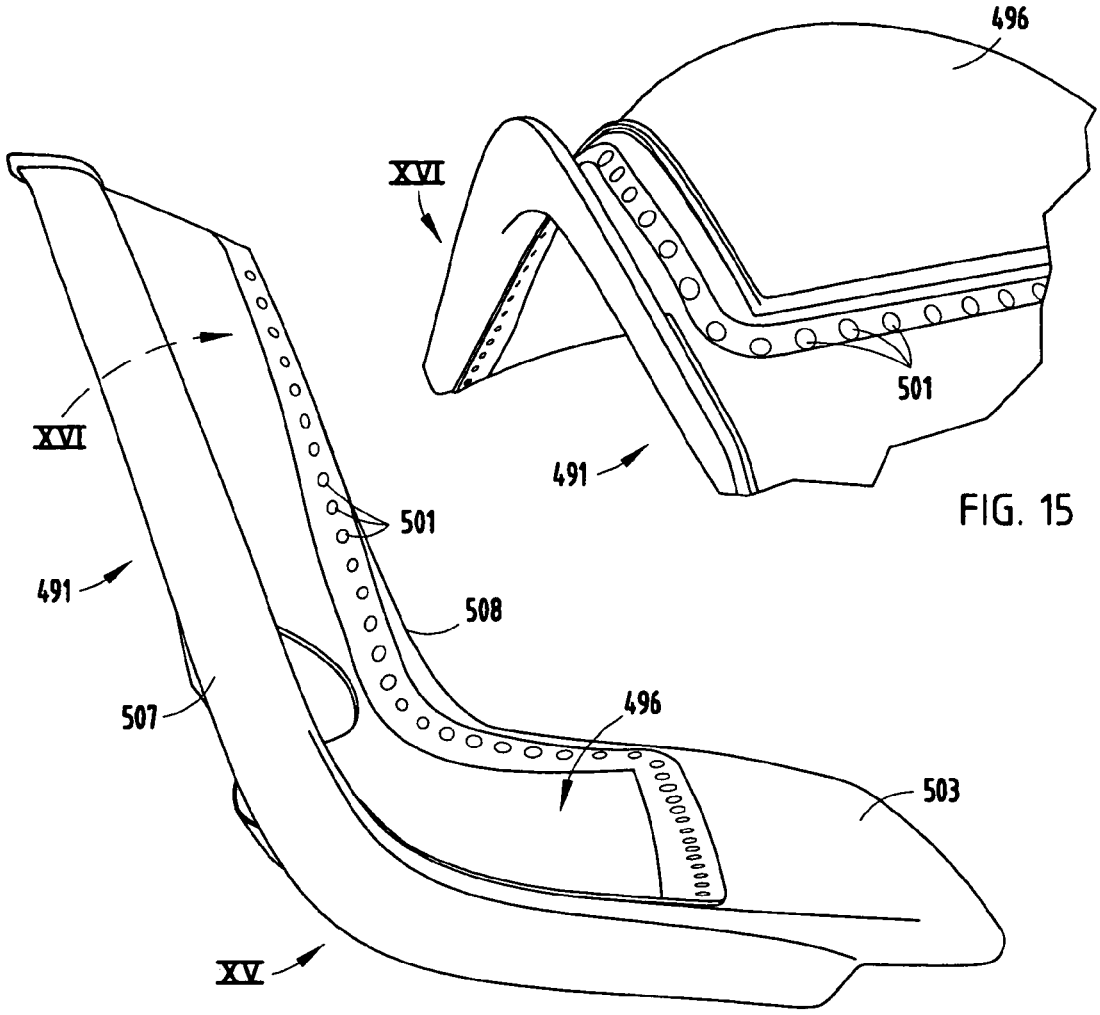
FIG. 15
FIG. 14
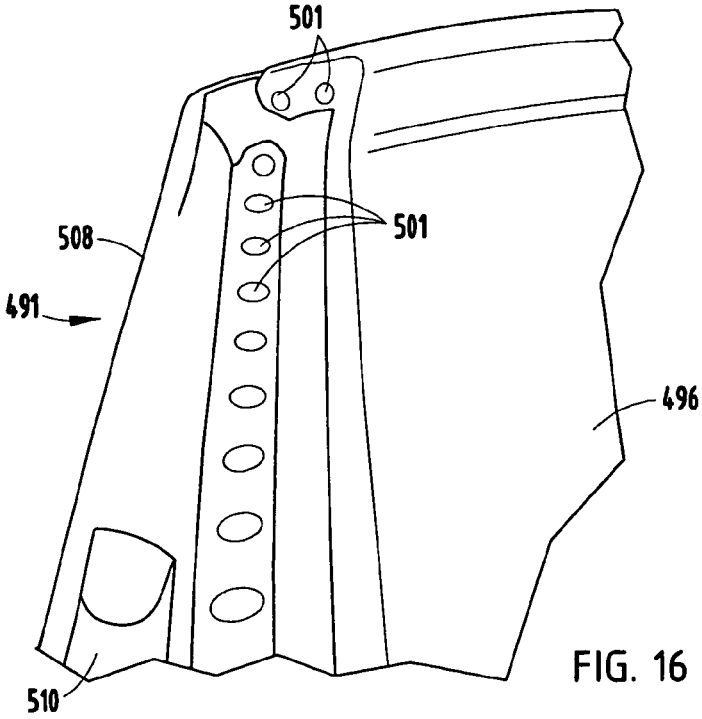
FIG. 16

SEATING UNIT WITH ACCESSORIES

BACKGROUND

The present invention relates to seating units having accessories attached their frame, such as to an armrest support.

Modern consumers want chairs and seating units to be functional and practical for supporting teaming activities and individual preferences, including the ability to stably hold and support such things as a beverage or cup, to provide a work surface that can be manipulated to different use and non-use positions, to provide accessories for holding and/or storing papers, and to be otherwise adaptable for different uses. At the same time, consumers want functionality and adaptability without complexity and without the functional feature interfering with multi-tasking and group discussion. Still further, they want replaceability, retrofitability, and removability, so that the functional items can be replaced, upgraded, and/or stored when not needed. Also, it is desirable to provide for dense storage of the seating units. Still further, consumers want customizability yet without substantial increased costs. Consumers also require style and elegance, while requiring structural integrity and durability and without sacrificing comfort.

Thus, a system having the aforementioned advantages and solving the aforementioned problems is desired.

SUMMARY OF THE PRESENT INVENTION

In one aspect of the present invention, an armrest apparatus includes an upright support, an armrest supported atop the upright support, and an accessory rotatably attached to the upright support for adjustment between different positions relative to the armrest.

In another aspect of the present invention, a seating apparatus includes a seating unit having a frame, and a support extending from the frame. The support has a top section configured to both rotatably support a first device, such as a cup holder or tablet, and shaped to non-rotatably support a second device, such as an armrest.

In another aspect of the present invention, a seating unit includes a frame for supporting a seated user, and a retainer engaging the frame. An armrest and also an accessory are supported by the retainer in desired coordinated positions relative to the seated user.

In another aspect of the present invention, a seating unit includes a base adapted to stably engage a floor surface, a supportive frame member and a sheet support. The supportive frame member is supported on the base and defines at least one of a seat section and a back section, the one section defining an opening. The supportive frame member defines a perimeter frame extending at least partially around the opening to two opposing sides of the opening. The sheet support is co-molded onto the supportive frame member, and has edge strips overlapping the perimeter frame that are secured to the opposing sides with integrally formed rivet-simulating protrusions that engage apertures in the supportive frame member.

These and other aspects, objects, and features of the present invention will be understood and appreciated by those skilled in the art upon studying the following specification, claims, and appended drawings.

BRIEF DESCRIPTION OF DRAWINGS

FIG. 14 is a perspective view of a side of the back and seat of the seating unit of FIG. 10.

FIGS. 15 and 16 are fragmentary perspective views of FIG. 14, each of FIGS. 15 and 16 being taken in the direction of arrows XV and XVI in FIG. 14.

DETAILED DESCRIPTION OF PREFERRED EMBODIMENTS

Figure 1:
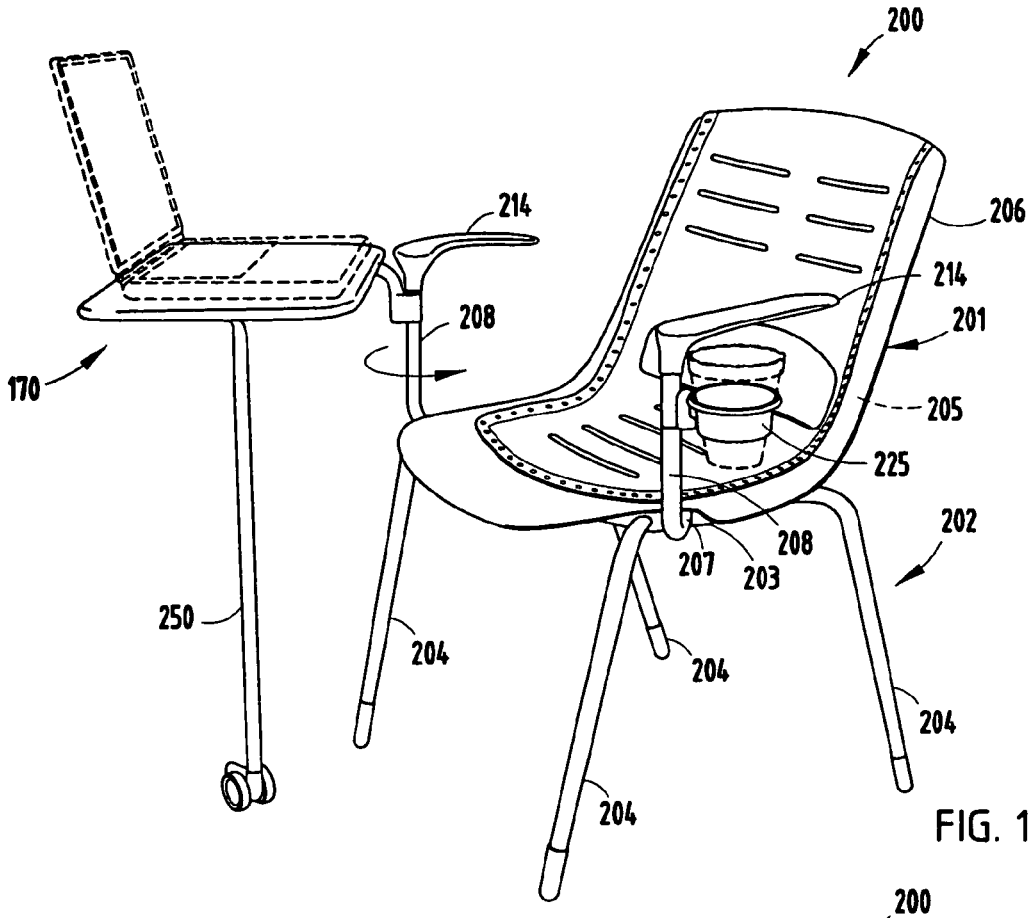
FIGS. 1 and 1A are perspective views of a seating unit embodying the present invention, including a cup holder accessory and a tablet accessory rotatably mounted on respective right and left armrest supports by retainers, FIG. 1 showing the tablet in a storage position and FIG. 1A showing the tablet in a use position centered relative to a seated user.
Figures 2, 2A:
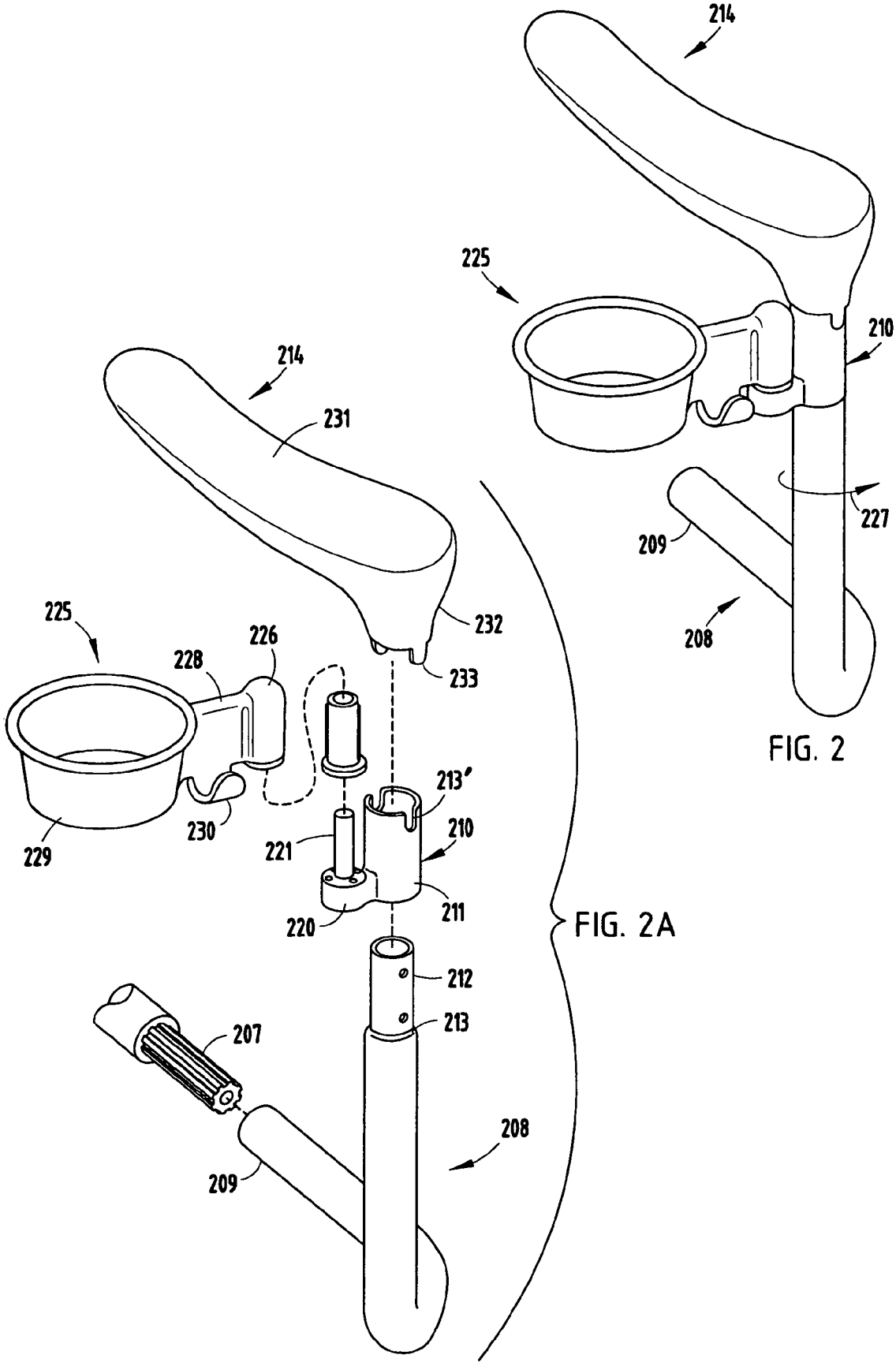
FIGS. 2 and 2A are a fragmentary perspective view and a related exploded perspective view of the support, retainer, armrest, and cup holder accessory shown in FIG. 1.
Figure 3A:
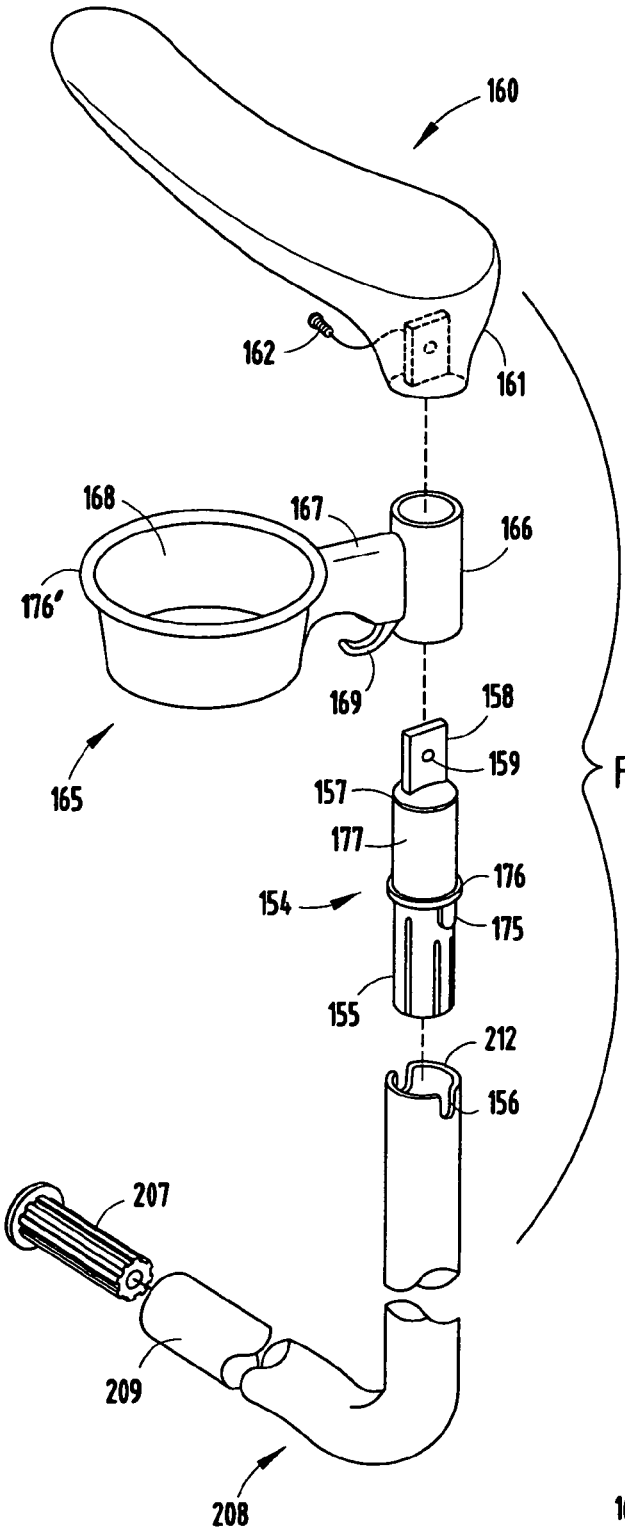
FIGS. 3 and 3A are a fragmentary perspective view and a related exploded perspective view of a second arrangement including a support, retainer, armrest, and cup holder accessory similar to that shown in FIG. 1, but modified so that the retainer is in-line with the support as described below.
Figure 3:
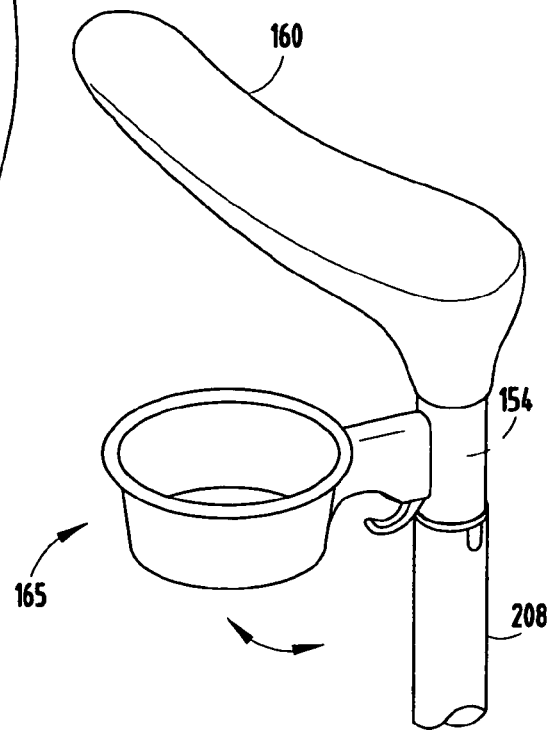
Figure 4:
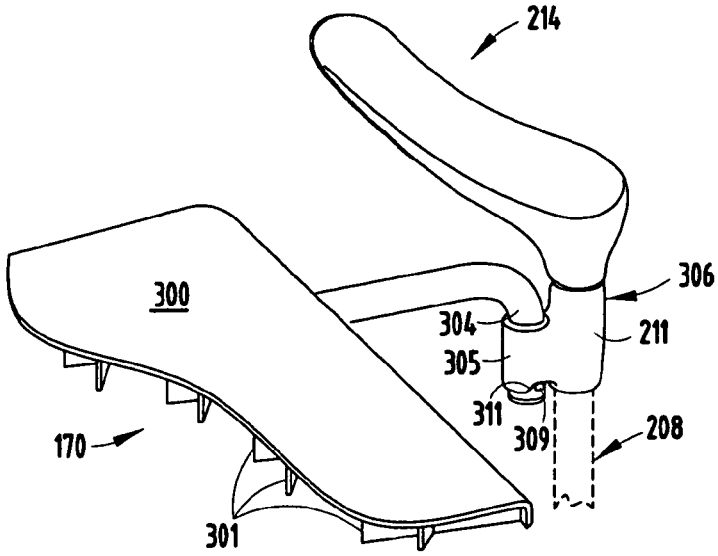
FIGS. 4 and 4A are a perspective view and a related exploded perspective view of a seating unit similar to FIG. 1, including a tablet supported on the armrest support.

The present seating unit (FIGS. 1-2) includes a chair frame having right and left tubular supports mounted permanently (or removably) to the frame of the chair for selectively supporting one or both of armrests and also accessories, such as a cup holder accessory and/or a tablet accessory. Specifically, a retainer fits onto the support and includes a support-engaging structure and also includes an accessory-supporting structure either adjacent the support (see FIGS. 2-2A and 4-4A) or in-line with the support (see FIGS. 3-3A). By this arrangement, seating units can be produced with or without accessories attached to the seating unit, with all versions being aesthetically acceptable and functionally robust, durable, and functional.

A first version of the seating unit 200 (FIG. 1) includes a seat and back component 201 supported by a tubular frame 202. It is contemplated that a scope of the present invention includes different seat and back components and different supporting frames. The illustrated seating unit 200 is commonly referred to as a side chair, but it is contemplated that additional seating units can be constructed using the present inventive concepts. Accordingly, the present invention is not intended to be unnecessarily limited and concurrently, the term "seating unit" as used herein is intended to be broadly construed.

The illustrated frame 202 includes an underseat portion 203 with four legs 204 extending downwardly from each corner and with a pair of back-supporting side frame members 205 extending upwardly from a rear area on the frame 202 for supporting the back 206 of the seat and back component 201. A protruding mount 207 (FIG. 2A) extends laterally from a front corner area of the frame 202 on both right and left sides of the seating unit 200. A tubular armrest support 208 (also called an "upright") includes a lower end 209 shaped to frictionally non-rotatably engage the mount 207. For example, the illustrated mount 207 includes splines configured to axially engage mating structure within the lower end 209. The support 208 extends outwardly and then upwardly to a position adjacent a front and side area of the chair, at a location generally located at a front of where an armrest might be located.

A retainer 210 (FIG. 2A) includes a first cylindrical sleeve 211 shaped to fit onto an upper configured end 212 of the support 208. The upper configured end 212 has a reduced diameter and forms a supporting ridge 213 that abuts a bottom of the sleeve 211 for supporting the retainer 210 at a desired height generally lower than the associated armrest. The illustrated configured end 212 is press-fit or otherwise non-rotatably secured to the upper end 212 and further includes non-uniform structure such as notches 213' for engaging and non-rotatably supporting an armrest 214. By this arrangement, the armrest is sufficiently stable for comfortable use. However, it is contemplated that the retainer 210 could be made to be rotatable on the upper end 212, if desired. In such case, the inter-engaging surfaces would be made to provide a desired level of friction such that the retainer 210 would stay in a desired angular position once adjusted. Alternatively, it is contemplated that the inter-engaging surfaces could have an undulating shape (e.g., on ridge 213), or have an inter-engaging member (such as a spring-biased ball that engages a mating undulated surface adjacent the ridge 213) such that rotation of the retainer would provide a detented feel upon rotation.

The retainer 210 (FIG. 2A) includes a laterally-extending mounting arm 220 that extends from the first sleeve 211 near a bottom thereof. A rod-like pintle 221 is attached to the mounting arm 220 and extends upwardly. Pintles are generally known in the art and are often used, for example, for attaching castors to spider-legged chair bases. The illustrated pintle 221 is attached to the mounting arm 220 by rivets or screws, but it is contemplated that it could be insert-molded or otherwise secured in place to the arm 220.

The cup holder accessory 225 (FIG. 2A) includes a socket-forming end 226 shaped to fit vertically downwardly engage the pintle 221. The inter-engagement supports rotation, as illustrated by arrow 227 (FIG. 2), but provides sufficient friction to hold the accessory 225 in a selected angular position. It is contemplated that a detent-forming structure such as a spring-biased ball engaging an undulating surface can be provided (e.g., at a bottom of the end 226 at the interfacing surfaces of the end 226 and the arm 220) for providing a detent feel as the accessory 225 is rotated to various angular positions. The accessory 225 further includes a beam-like arm 228 that extends from the socket-forming end 226. A ring 229 is supported on the outer end of the arm 228, the ring being shaped to engage and support a beverage container. It is contemplated that the ring 229 can include a floor or bottom wall (flexible or rigid), or alternatively can be taper-shaped and sized to support a standard paper coffee cup.

The illustrated accessory 225 includes a hook 230 that extends downwardly and outwardly from a bottom of the arm 228, such as for supporting a coffee cup or other article in a hanging position. Notably, other accessories can be made by substituting various structures for the cup holder ring 229 and/or the hook 230. These can include pencil-holders, paper holders, electronic-supporting holders, etc.

The armrest 214 (FIG. 2A) is elongated and includes a body having a relatively flat top surface 231. A rearward end of the body is relatively thinner, and a forward end is relatively thicker. A mount 232 is formed at the forward end, and defines a downwardly open structure shaped to matingly engage the open upper end 212 of the support 208. In particular, the mount 232 includes a recess for receiving the upper end 212 and also includes protruding tabs 233 for engaging the notches 213' in the upper end 212. Reinforcement ribs are formed around the mount 232 as required for stability and durability. A setscrew can be provided for providing an extra secure retention of the armrest to the support 208, if desired. It is contemplated that the armrest 214 can include cushion material and/or upholstery covering and/or other treatment for aesthetics and function. It is also contemplated that the armrest 214 could be made to be adjustable, such as by including a top member that is movable/adjustable on the body of the armrest 214.

A second embodiment (FIGS. 3 and 3A) includes a molded or cast arm retainer 154 having a bottom 155 that press-fittingly plugs into the open end of the upper end 212 of the armrest support 208 and includes protrusions 175 that register into engagement with index notches 156 in a top end of the support 208, with a ring 176 on the retainer 154 engaging a top of the support 208. An upper end 157 of the retainer 154 includes a blade-like flat portion 158 with a hole 159 therein. An armrest 160 includes a downwardly facing mount 161 with an opening that matably fits onto the flat portion 158, and includes a screw 162 that fits through a hole in the armrest 160 and through the hole 159 threadably into the armrest 160 to securely retain the armrest 160 on the retainer 154.

A cup holder accessory 165 (FIG. 3A) is provided that includes a tubular end section 166 that telescopingly fits onto a middle section 177 of a protruding annular retainer 154 above the ridge/ring 176 for holding the accessory 165 on the chair. The accessory 165 includes a cantilever arm 167 supporting a cup holder 176' defining a section recess 168 (or tablet or box-like storage container for holding papers, cell phone holders, or other accessorizing device), and includes a hook 169 that extends downwardly from the arm 167 for holding items under the accessory 165. The illustrated tubular end section 166 is rotatably supported by the retainer 154 above the ring 176 on a relatively smooth cylindrical bearing surface of middle section 177 for rotation between a use position and a non-use (storage) position. It is conceived that the surface of section 177 could be non-cylindrical or to include bumps to provide a detented feel upon rotation. The illustrated accessory 165 is supported in cantilever from the support 208, and is rotatable between a use position such as where the cup holder recess 168 is located generally over or forward of a seated user's lap, and a non-use position where the cup holder recess 168 is positioned off to a side (so that the person can exit the chair without interference). It is contemplated that the cup holder accessory 165 can be modified to form a container, such as by providing a lower wall or floor under the cup holder ring 176' for closing off the area under the ring 176'. Also, it is contemplated that different shapes of container accessories can be provided while staying with and utilizing the present inventive concepts.

Figure 3B:
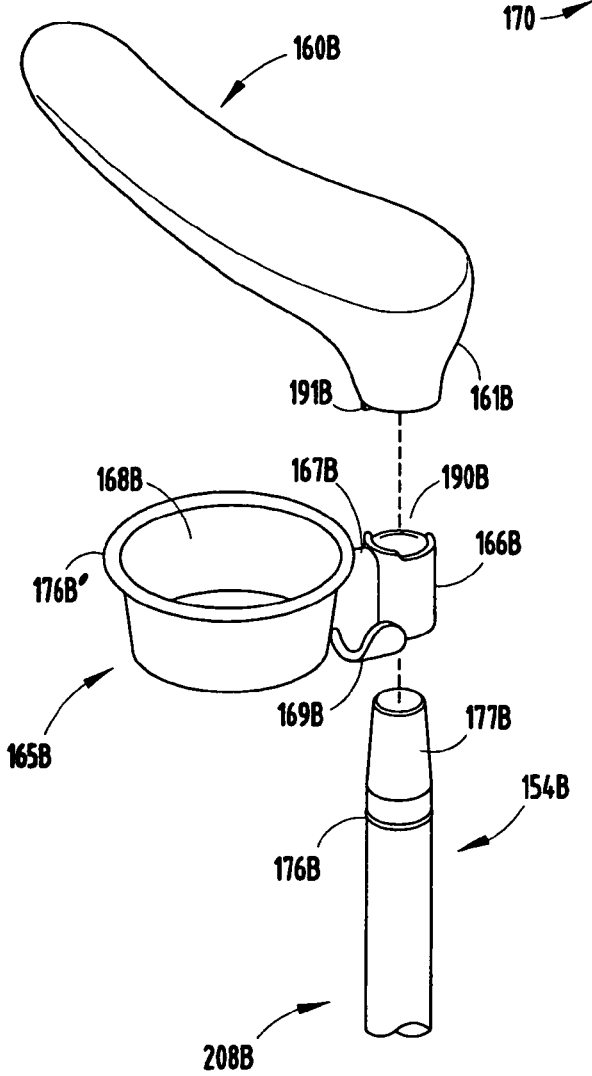
FIG. 3B is an exploded perspective view of a third arrangement similar to that shown in FIGS. 3-3A.
Figure 4A:
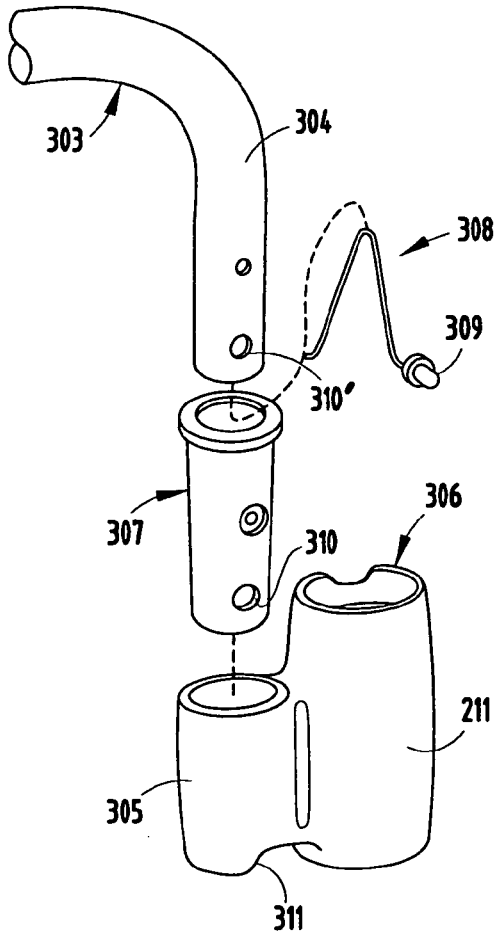

Another cup holder accessory 165B (FIG. 3B) is provided that is similar to accessory 165, but that includes a modified support/connection arrangement. Similar components, features, and characteristics are identified using the same numbers but with the addition of the letter "B". The accessory 165B includes a tubular end section 166B that telescopingly fits onto a frustoconically-shaped middle section 177B of the retainer 154B above the ridge/ring 176B for holding the accessory 165B on the chair. The accessory 165B includes a cantilever arm 167B supporting a ring-shaped cup holder 176B' defining a section recess 168B, and includes a hook 169B that extends downwardly and laterally from the arm 167B for holding items under the accessory 165B. The illustrated tubular end section 166B is rotatably supported by the retainer 154B above the ring 176B on a relatively smooth cylindrical bearing surface of middle section 177B for rotation between different use positions and non-use (storage) positions. The surface of section 177B is frustoconically-shaped such that it frictionally engages the tubular sleeve section 166B. The frictional engagement can be controlled by the selection of the materials having a particular coefficient of friction, or can be controlled by addition of a lubricant, or can be controlled by addition of a non-lubricious friction-producing material (sticky substance) or "bearing interface" sleeve. A top of the sleeve section 166B includes a notch 190B that extends about 90 degrees around the top edge of the sleeve section 166B. The armrest 160B includes a mount 161B having a protrusion 191B that engages the notch 190B to limit angular rotation of the cup holder accessory 165B to about 90 degrees. By making the notch 190B longer or shorter, or by repositioning the angular orientation of the notch 190B, the angular positioning of the cup holder accessory 165B can be controlled. The mount 161B of the armrest 160B telescopingly frictionally engages the frustoconically-shaped top of the retainer 154B. The armrest 160B can be held in a non-rotatable position either by frictional engagement with the retainer 154B, or if desired a screw (see screw 162 in FIG. 3A) can be extended through the mount 161B into the top end of the retainer 154B to create a more positive connection.

Figure 1A:
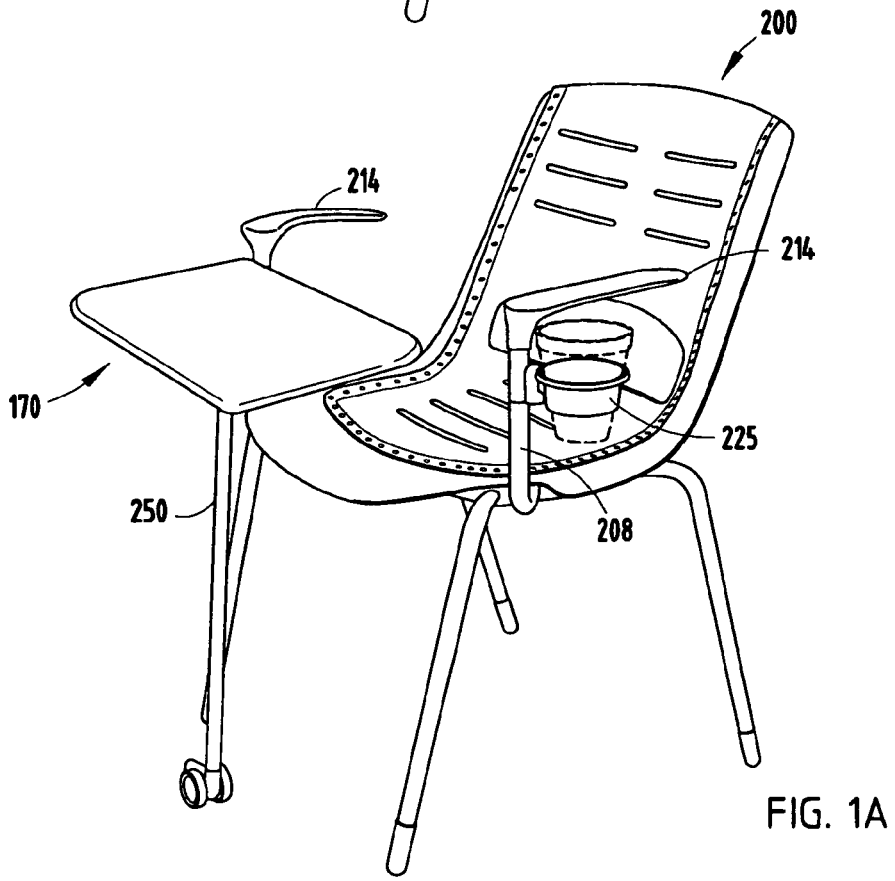
Figure 5:
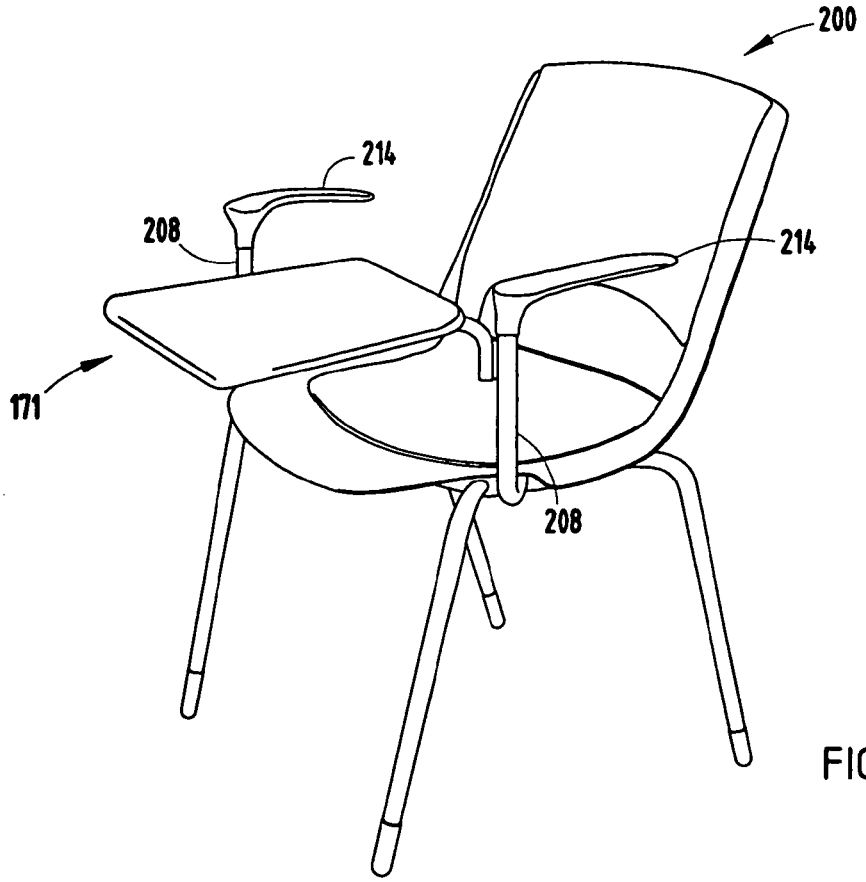
FIGS. 5 and 5A are perspective views of a seating unit like that shown in FIG. 1, but with a tablet supported in cantilever off the left armrest support in FIG. 5 and off the right armrest support in FIG. 5A.
Figure 5A:
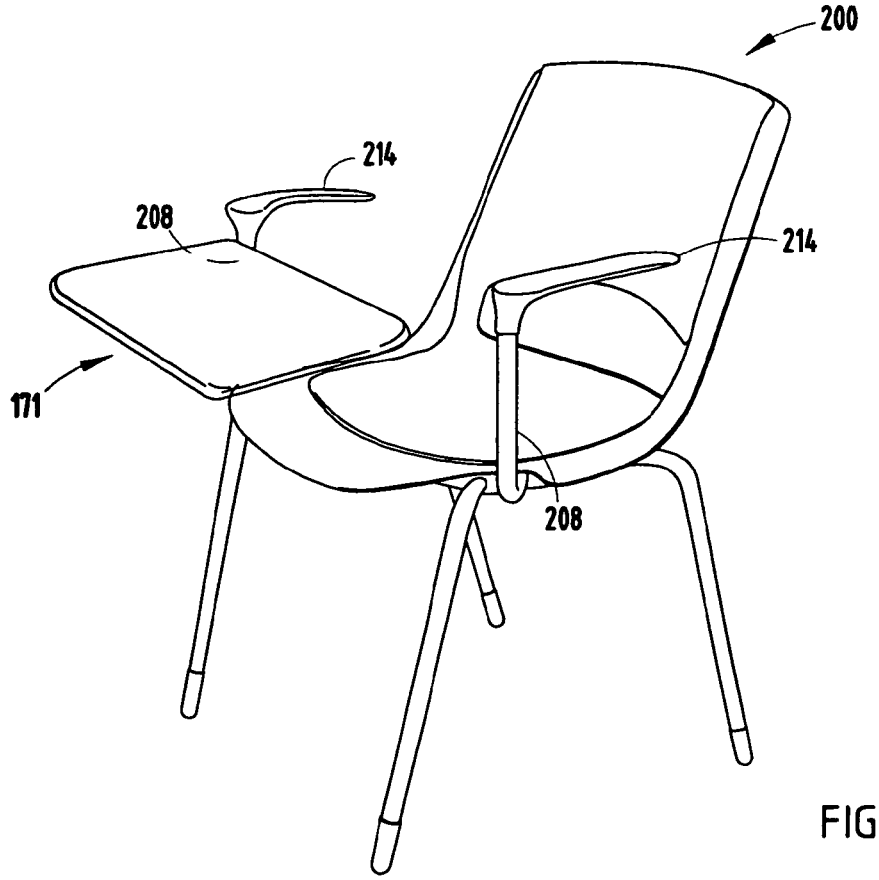
Figure 6:
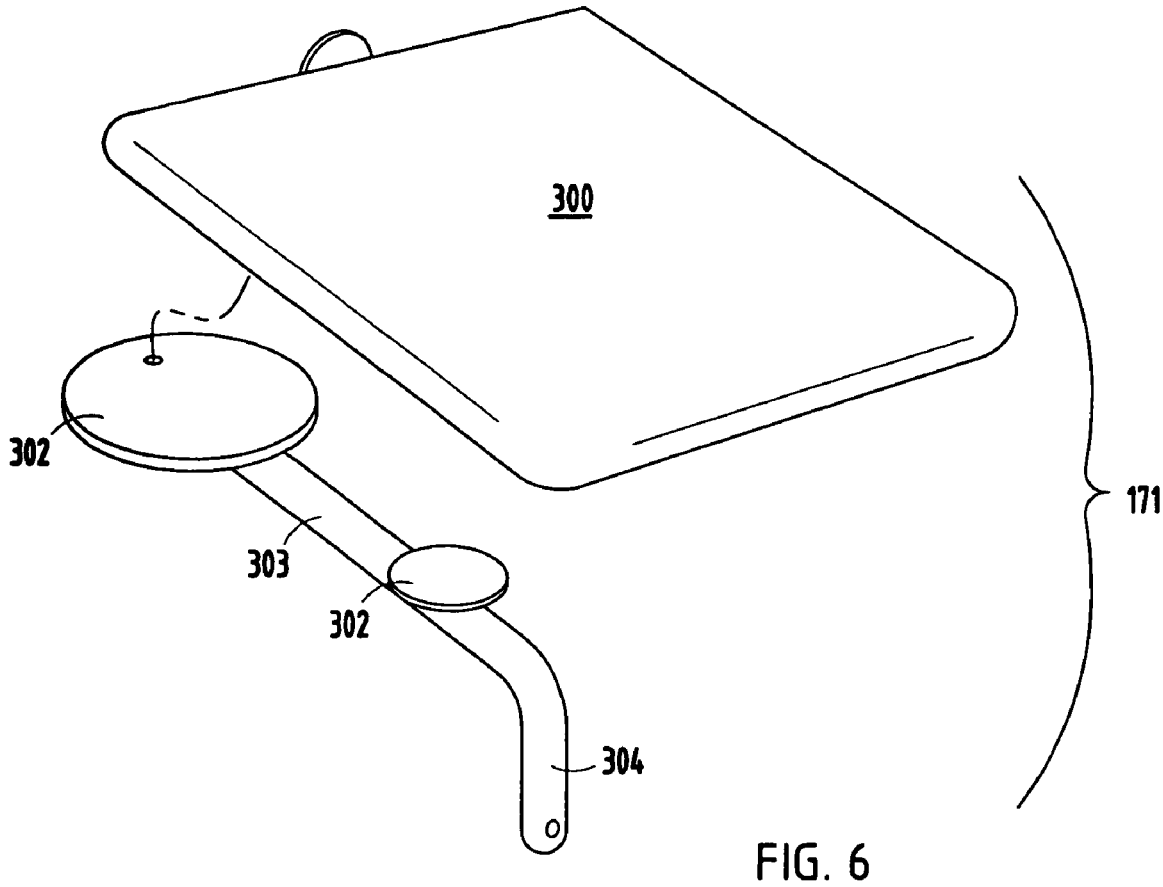
FIGS. 6 and 7 are perspective views of the tablet shown in FIG. 5, FIG. 6 being a top perspective showing the tablet and its supporting tubular section, and FIG. 7 being a bottom perspective showing structure on a bottom of the tablet.
Figure 7:
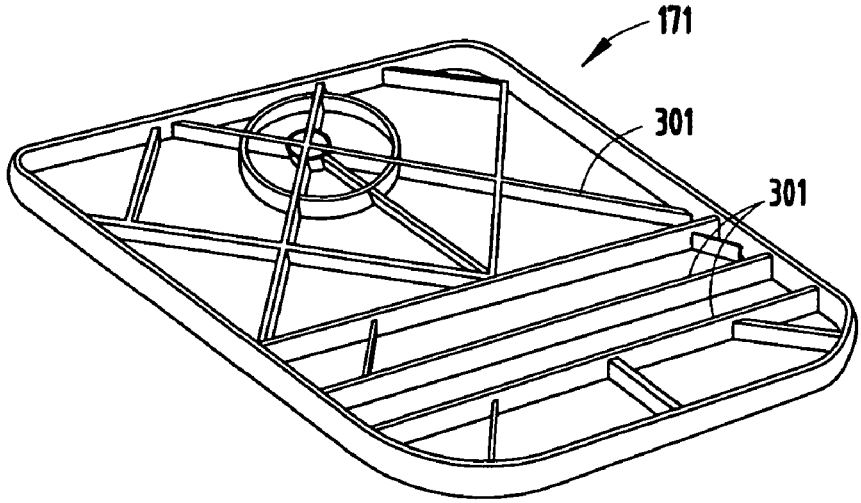
Figure 8:
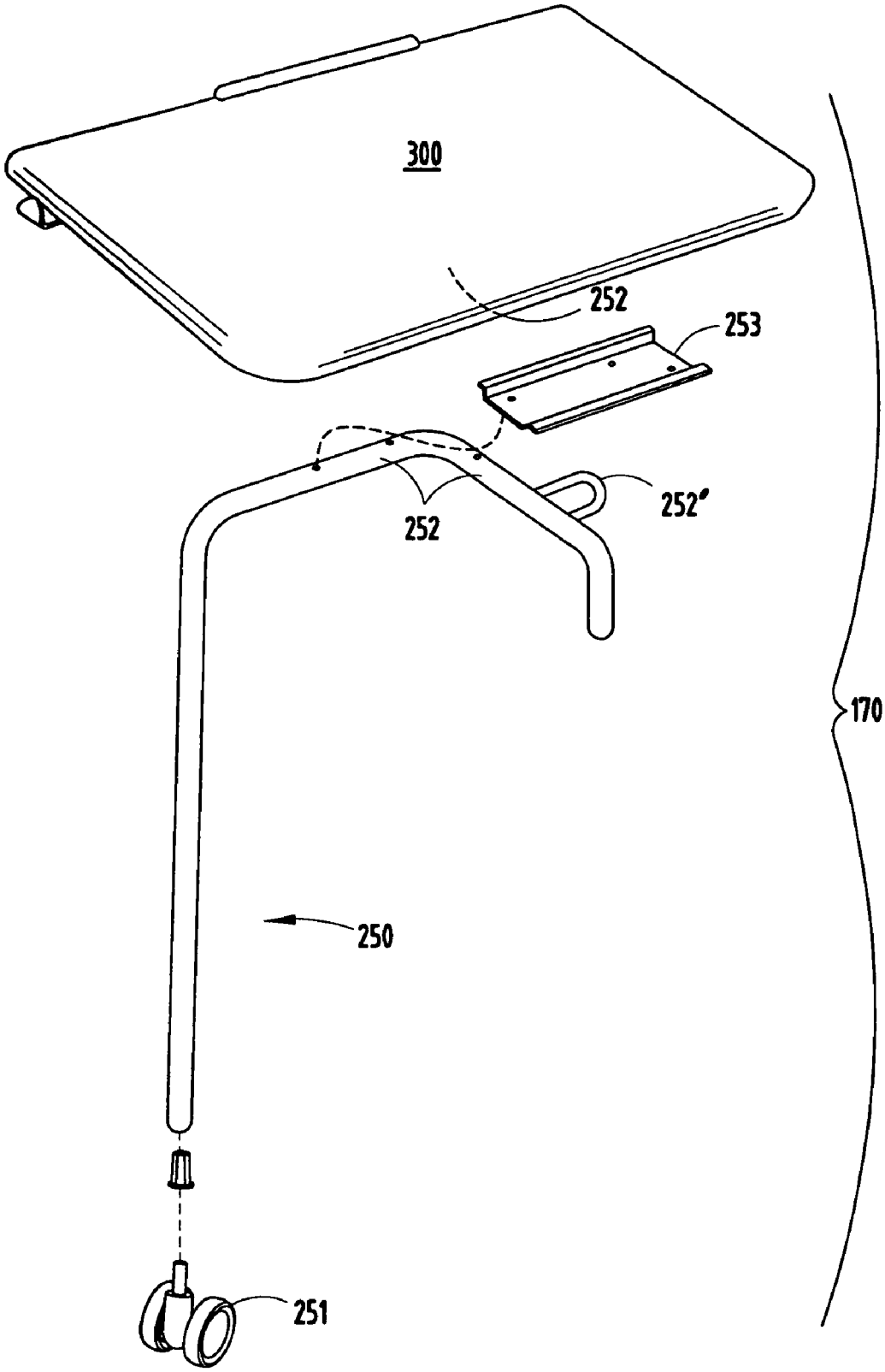
FIGS. 8 and 9 are perspective views of the tablet shown in FIG. 1, FIG. 8 being a top perspective showing the tablet and its supporting tubular section and wheeled supporting leg, and FIG. 9 being a bottom perspective showing structure on a bottom of the tablet.
Figure 9:
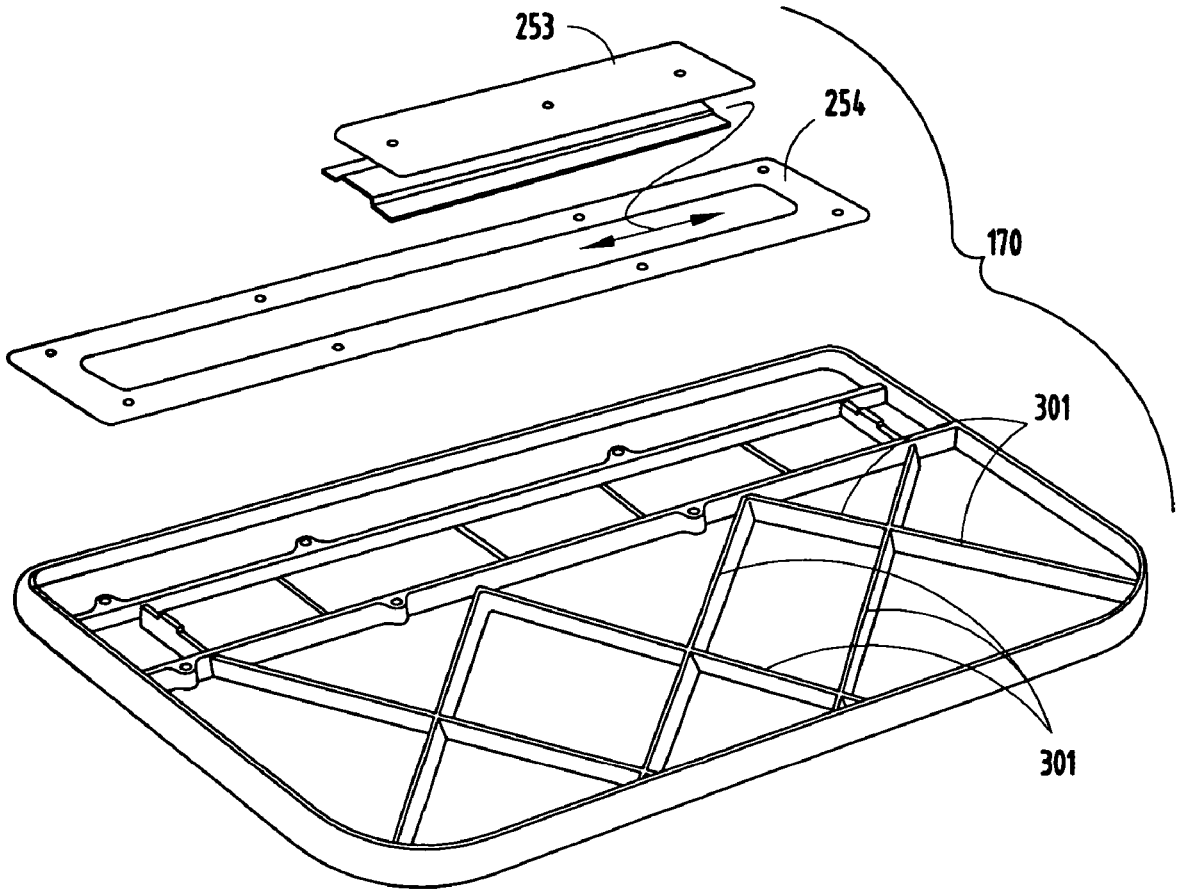
Figure 10:
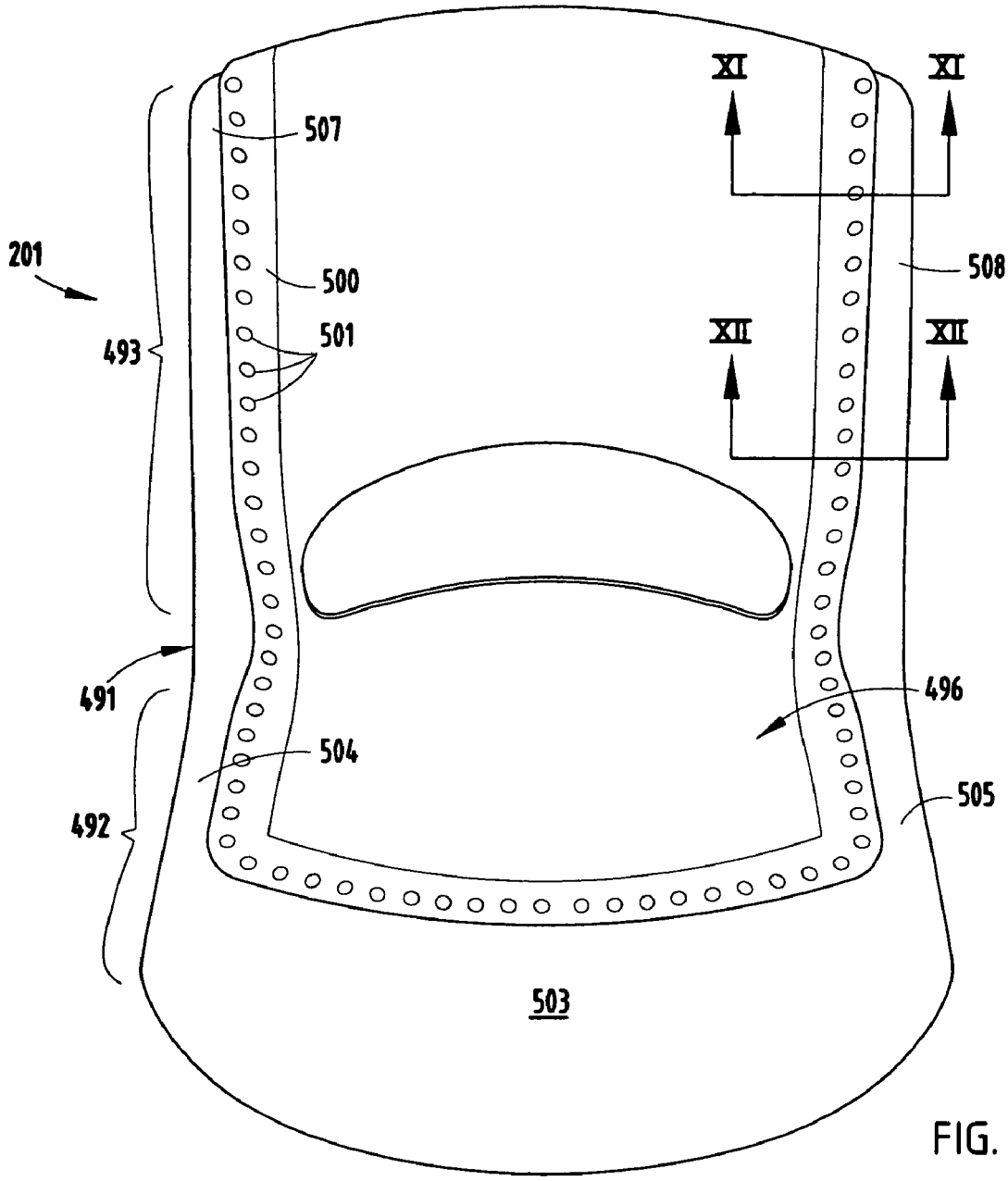
FIG. 10 is a front view of the back and seat structure shown in FIG. 1.
Figure 11:
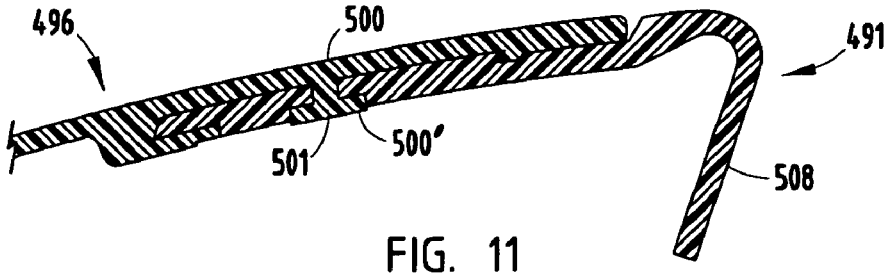
FIGS. 11-12 are fragmentary cross-sectional views taken along lines XI-XI and XII-XII in FIG. 10.
Figure 12:
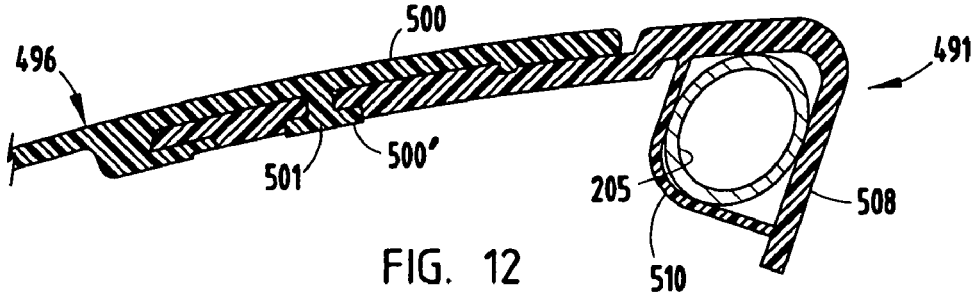
Figure 13:
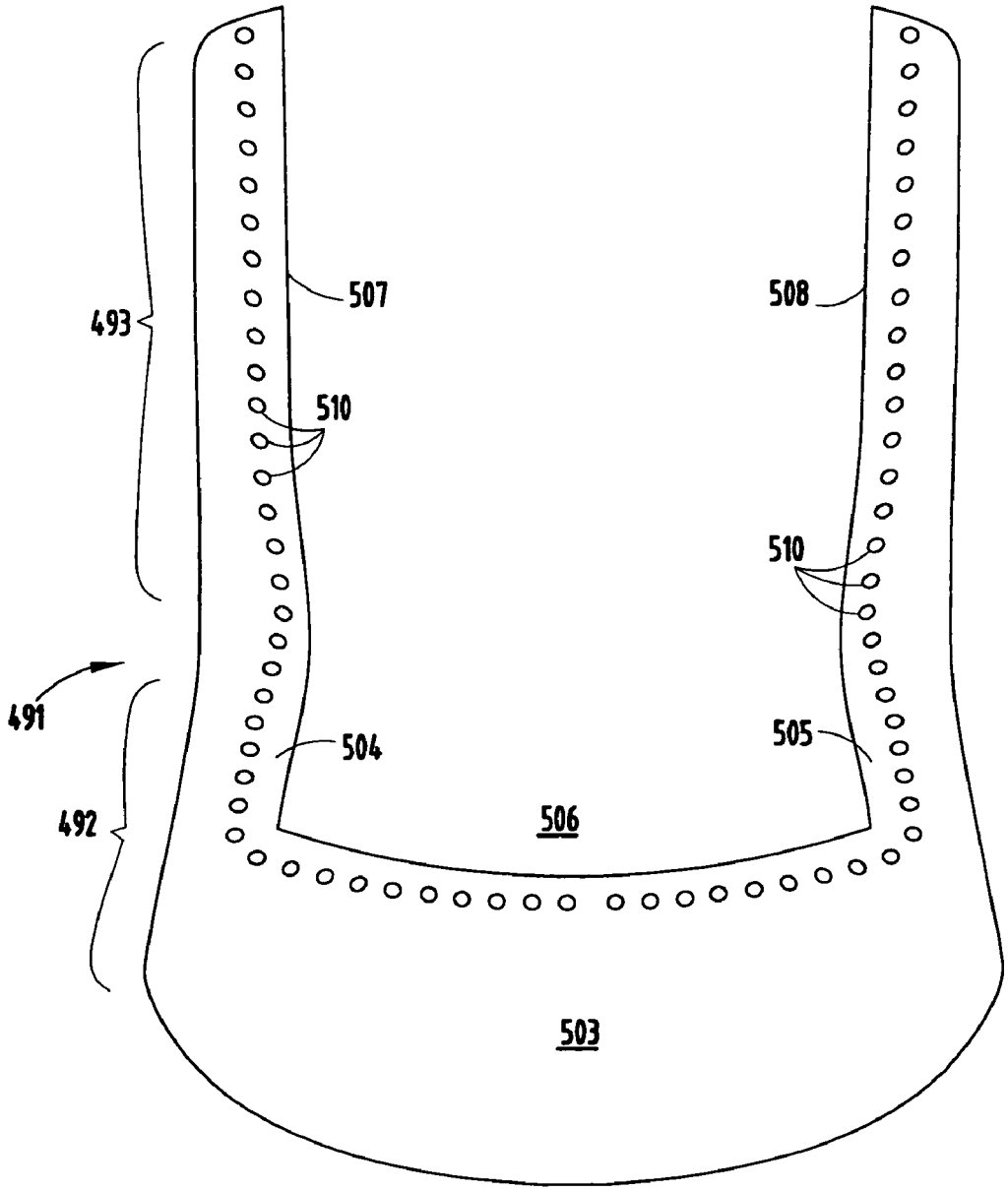
FIG. 13 is a front view of the supportive perimeter frame member in FIG. 10.

It is contemplated that other accessories can be supported on the support 208, such as a leg-supported tablet 170 (FIGS. 1, 4, 4A, 8) or a "no-leg" cantilevered tablet 171 (FIGS. 5, 5A, 6). Where the accessory is relatively heavy or may need to be designed to withstand substantial torsional loading, a wheeled leg 250 can be extended from the accessory (see tablet accessory 170 in FIG. 1) to support the accessory. Specifically, wheeled leg 250 (FIG. 8) includes a tubular vertical section that extends generally downwardly from the structural support for the tablet at a location generally under a center of gravity of the tablet 170. The leg 250 extends into contact with a floor surface and is adapted to support any "extra" weight on the tablet 170, in order to reduce cantilever forces on the support and related connections. The illustrated leg 250 includes a castor 251 secured to its lower end that rollingly engages the floor, permitting the tablet 170 and leg 250 to move between a first side of the chair (FIG. 1) where the tablet 170 is in a non-use (stored) position out of the way relative to a seated user, to a centered position in front of the chair (FIG. 1A) where the tablet 170 is in its use position generally in front of the seated user (with the leg 250 being generally at or between the knees of a seated user). The illustrated castor 251 is commercially available and is often used on chair bases for rollingly supporting an office chair on a floor surface. An upper section 252 of the leg 250 extends horizontally under the tablet 170 and is attached thereto to support the tablet 170 by brackets 253 and 254. The illustrated brackets 252 and 254 permit the tablet 170 to be adjusted longitudinally several inches along the subframe section 252. A hook 252' can be provided on the subframe section 252, if desired.

It is contemplated that the support can be an elongated structural member permanently attached to the chair frame. Alternatively, where armless versions of the chair are (or will be) offered, it may be desirable to provide a removable connection at the mounting stud. In such circumstance, the removable connection must be particularly stable and secure. In the illustrated arrangement in FIG. 2A, a male protrusion 207 is provided with splines forming a keyed arrangement, and the mating end of the upright support 208 includes internal mating ridges for frictionally wedgingly engaging the splines to prevent undesired rotation. Also, a setscrew or other securement device may be required to assure that the connection does not come loose over time.

A second keyed connection is formed at a top of the illustrated upright support 208 (FIG. 2) at the location where the retainer 154 (or retainer 210) attaches to the top of the support 208. In the illustrated arrangement, the keyed connection includes notches 213' in support 208, and the mating protrusions 175 below ring 176 in the retainer 154. It is contemplated that other keyed connections can be used, such as splines, and/or that fasteners or other securement can be used. Notably, the armrest 160 (FIG. 3) also is keyed to a top of the retainer 154 via flat portion 158. By this arrangement, the armrest 160 maintains its orientation relative to the chair, but the cup holder is rotatable. Alternatively, it is contemplated that the connection at the top of the retainer 154 or at a bottom of the retainer 154 can be made frictional but rotational so as to permit detented/controlled rotation, thereby allowing the armrest to be adjusted rotationally between different use (and non-use) positions. Notably, the retainer 154 telescopingly engages an open tubular section of the support 208, and also telescopingly engages a mating structure on a bottom of the armrest 160, and also telescopingly engages the mating structure on the cup holder accessory 165. These telescoping arrangements provide substantial stability and good assembleability, as well as replaceability. They also look aesthetically acceptable when, for example, the cup holder accessory 165 is not used. However, it is contemplated that the retainer could be modified to provide other supporting arrangements, such as providing a blade-shaped connector or clam-shell-like connector on the cup holder accessory 165 that laterally engages mating structure on the retainer 154 to provide rotational support to the accessory.

Tablets 170 and 171 include a tablet surface 300 (FIG. 4) with reinforcement ribs 301 formed thereunder as required for structural support. An under-tablet tubular frame 302 (FIG. 6) is attached to the tablet surface 300 and includes a tubular arm 303 that extends laterally from a corner thereof. The arm 303 includes a downturned end section 304 shaped to fit into a sleeve-like socket 305 (FIG. 4A) of a modified retainer 306. The retainer 306 is similar to the retainer 154 but includes the socket 305 positioned adjacent the "primary" sleeve 211 instead of the pintle 221. An injection-molded nylon sleeve 307 fits into the socket 305 and provides support to the downturned end section 304. A spring 308 is shaped to fit within the cavity of the end section 304. A button 309 is attached to the spring 308 and extends through a hole 310 in the bearing sleeve 307 through a hold 310' of the downturned end section 304 and into detenting engagement with a feature 311 on the retainer 306. This provides a detent arrangement that provides a detented feel upon rotation of the tablet 170 (or 171) and also provides a way of holding the tablet in a selected position (i.e., either a use position in front of the chair or a non-use storage position at a side of the chair).

It is contemplated that the cup holder accessories 165 and 225 and/or the tablet accessories 170 and 171 (and also the accessory 171A discussed below) can be mounted on the support 208 located on either side of the seating unit (see FIGS. 5 and 5A). It is also contemplated that the chair frame can be made to permanently incorporate the structure of the retainers as an integral part of the support 208 on one or both sides. It is also contemplated that the retainer can be made as a permanent or separate (replaceable) component removable from the support 208 on one or both sides of the seating unit. It is noted that the seating unit 200 is stackable for storage, with each successive seating unit 200 being about 1-½ inches above the underlying seating unit 200. Where the cup holder accessory 165 is only 1-½ inches or less in thickness, it does not interfere with stacking the seating unit 200 for dense storage. This is an advantage, since known stackable chairs do not include cup holders that permit stacking.

Figure 17:
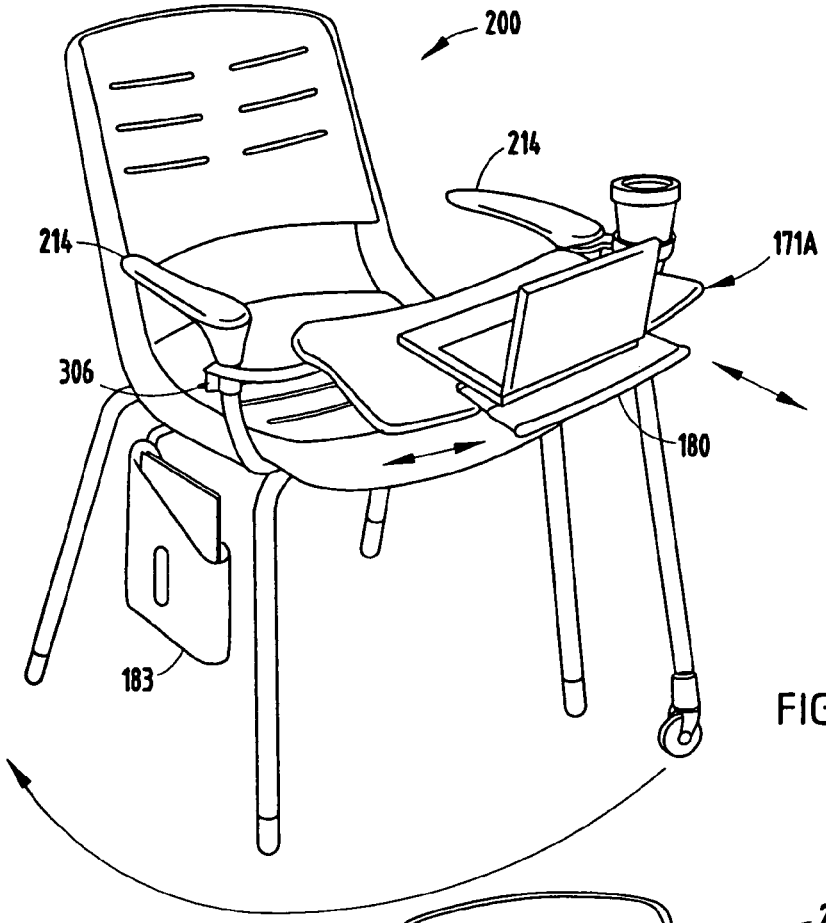
FIGS. 17 and 18 are perspective views of a seating unit similar to FIG. 1, but including a modified rotatable tablet having an extendable panel and showing a paper management storage device attached to the seating unit.
Figure 18:
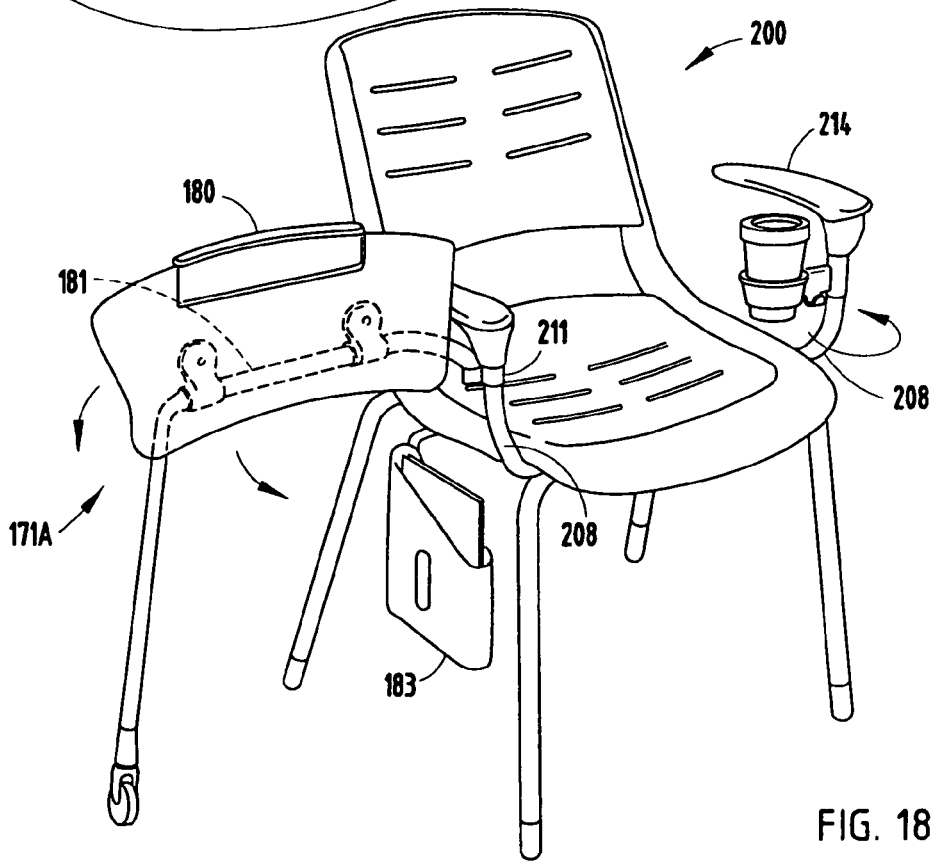

It is further contemplated that the tablet can be provided with additional options. For example, FIGS. 17-18 illustrate a tablet 171A that is similar to tablet 171 but that includes an extendable panel 180 telescopingly movably mounted within a cavity in the main body of the tablet 171A and extendable to increase a top surface of the tablet 171A. Also, the tablet 171A is rotatably mounted on a horizontal section 303 of the leg 170 for movement between a horizontal use position (FIG. 17) and a vertical storage position (FIG. 18). It is contemplated that a single tablet can be made that is usable on right or left sides. Also, the tablet can be rectangular or square, with curved or straight sides. Where the supporting arm section 303 is bent in a horizontal plane partially around the support 208, or where the socket 305 is positioned at an optimal angle relative to the sleeve 211 on support 208, the tablet can made to lie completely adjacent and parallel a side of the seat of the seating unit when in its storage position. It is noted that wire management devices such as tubular sleeve and/or pouch 183 can be attached to the legs of the seating unit and/or to the support 208.

The basic seating unit 200 (FIGS. 10-16) with the illustrated frame 390 and shell 391 is adapted to be stacked in a nested arrangement for dense storage, with each successive chair adding about 1-½ inches to a height of the stack of chairs. The cup holder accessories can be attached to the stacked chairs, where the cup holder accessory does not take up more than 1-½ inches in total height when in a stacked condition. Similarly, the "no-leg" tablet accessory can also be on a stacked arrangement of chairs without interfering with the stacking.

The illustrated sheet-like support 396 (FIGS. 10-11) is one-piece and includes seat and back sections 397 and 398 connected by side strips 399, each of which overlappingly matably engage a front surface of the corresponding sections 392-394 of the shell 391. The cushion 396 can be foam-like or gel-like in its physical properties.

The seating unit 201 includes a shell 491 defining a large opening, and a sheet-like support 496 co-molded onto the shell 491. The shell 491 includes a seat section 492 with a transverse front section 503 and rearwardly extending side sections 504 and 505 defining a U-shape around an opening 506. The back section 493 of the shell 491 includes vertically extending side section 507 and 508 that form a parallel goal-post-like arrangement from side sections 504 and 505. The illustrated side sections 507 and 508 are not structurally connected, but it is contemplated that they could be interconnected at their upper ends by an arching top member for strength. The opening 506 is defined in part between the side sections 507-508. The sections 503-505 and 507-509 include a series of regularly spaced apertures 510 for attachment purposes, as disclosed below.

The illustrated sheet-like support 496 is co-molded onto the shell 491 as follows. The shell 491 is made of a glass-filled polyester material or other structural plastic that is relatively rigid, but having some ability to flex. The illustrated sheet-like support 496 is made of a non-foam thermoplastic flexible/resilient thermo-plastic or thermoset polyurethane having good tensile strength and a limited amount of stretchability, such as about ⅛ inch to ¼ inch thick. The shell 491 includes a series of regularly-spaced apertures 510 along its border. The sheet-like support 496 includes a top/front border strip 500 of material, and includes a plurality of regularly spaced integrally-molded rivet-like headed protrusions 501 that extend through the apertures in the border strip 500. The protrusions 501 are molded as part of support 496 and form a rivet-like securement of the sheet-like support 496 to the shell 491, with heads of the protrusions 501 interlockingly engaging the shell 491 to retain the support 496 on the shell 491 in a tensioned suspended position. The illustrated second border strip 500' interconnects the heads of protrusions 501 and extends along the rear/bottom of the sheet support 496 parallel the top border strip 500, with the material of the sheet support 496 being tensioned between the sections 503-505 and 507-508 (due to shrinkage during the molding process). As illustrated, the sheet support 496 comprises a continuous polyurethane. It is noted that, where the polyurethane foam is translucent, the rivet-like protrusions 501 have an aesthetically pleasing novel appearance. Where the side sections 503-505 and/or 507-508 require additional strength, a reinforcement can be molded into them or reinforcement ribs can be formed thereon. The illustrated tubular section shown in FIG. 12 and formed by inner wall 510 is formed by gas-assisted injection-molding techniques, which are known in the art of injection-molding. Notably, the tubular upright 205 (FIG. 1) fits into the cavity of the back section 507-508 inside of the wall 510. Alternatively, the upright 205 can fit against an open-sided channel formed under sections 504-505 and 507-508.

It is contemplated that the present inventive concepts can be used on a side chair as shown, or can be incorporated into office chairs such as task chairs (for example, a pedestal chair). It is also contemplated that the present concepts can be incorporated into any seating unit, such as benches, lounge chairs, class room chairs, and seating units for vehicles (planes, trains, boats, mass transit, etc.). Still further, it is contemplated that the present concepts can be incorporated into other furniture units and systems, and into other arrangements where it is desirable to support multiple items in an arrangement where an adjustable functional component preferably has a coordinated position relative to an armrest.

It is to be understood that variations and modifications can be made on the aforementioned structure without departing from the concepts of the present invention, and further it is to be understood that such concepts are intended to be covered by the following claims unless these claims by their language expressly state otherwise.

The embodiment for which a property right or privilege is claimed includes:

1. An armrest apparatus comprising:

an upright support;

an armrest supported atop the upright support; and an accessory rotatably attached to the upright support for adjustment between different positions relative to the armrest, wherein the upright support includes a retainer that extends upwardly and that includes a first mounting structure for supporting the armrest and a second mounting structure for supporting the accessory, and wherein the second mounting structure includes a circumferentially-extending structure for rotatably supporting the accessory.

2. The apparatus defined in claim 1, wherein the upright support provides cantilevered support to the armrest at a location generally at a front of the armrest.

3. The apparatus defined in claim 2, wherein the upright support is a sole support for the armrest.

4. The apparatus defined in claim 1, wherein the first mounting structure is located at a top of the retainer and includes a keyed connection to prevent rotation of the armrest.

5. The apparatus defined in claim 1, wherein the support includes a tubular section with an open end, and wherein the retainer includes a bottom that is configured to non-rotatably engage the open end.

6. The apparatus defined in claim 1, wherein the support includes a tubular section, and wherein the retainer removably engages the tubular section.

7. The apparatus defined in claim 1, wherein the support includes a tubular section, and wherein the retainer telescopingly engages the tubular section at a lower end and also telescopingly engages the armrest at an upper end.

8. The apparatus defined in claim 1, wherein the accessory is selected from a group consisting of one of a tablet, a container, and a cup holder.

9. The apparatus defined in claim 8, wherein the accessory includes at least the cup holder.

10. The apparatus of claim 1, wherein the accessory includes a tablet and an accessory-supporting leg extending downward from the tablet for engaging a floor surface.

11. The apparatus defined in claim 10, wherein the accessory leg includes a floor-engaging bottom part located generally below a center of gravity of the tablet.

12. The apparatus defined in claim 1, wherein the support includes a lower end configured and adapted to be removably attached to a chair frame.

13. The apparatus defined in claim 1, wherein the armrest is removably attached to the support.

* * * * *